United States Patent [19]

Iimura et al.

[11] Patent Number: 4,619,213

[45] Date of Patent: Oct. 28, 1986

[54] DRIVE CONTROL MECHANISM OF SEWING MACHINE

[75] Inventors: Ikurou Iimura, Kanagawa; Kuniharu Sakuma; Haruo Iwabuchi, both of Tokyo, all of Japan

[73] Assignee: Tokyo Juki Industrial Co., Ltd, Chofu, Japan

[21] Appl. No.: 655,363

[22] Filed: Sep. 27, 1984

[30] Foreign Application Priority Data

Sep. 30, 1983 [JP] Japan ..... 58-183458
Sep. 30, 1983 [JP] Japan ..... 58-183459

[51] Int. Cl.[4] ..... D05B 69/36

[52] U.S. Cl. ..... 112/273; 112/277; 112/278

[58] Field of Search ..... 112/302, 273, 278, 241, 112/243, 121.12, 275, 277

[56] References Cited

U.S. PATENT DOCUMENTS 4,215,641 8/1980 Dobrjanskyj et al. ..... 112/302 X
4,237,807 12/1980 Meier et al. ..... 112/278
4,408,554 12/1983 Takiguchi et al. ..... 112/302
4,432,297 2/1984 Kemmel ..... 112/278

*Primary Examiner*—Peter Nerbun
*Attorney, Agent, or Firm*—Yount & Tarolli

[57] ABSTRACT

A drive control mechanism and a safety device in a sewing machine in which thread in a predetermined amount necessary for the formation of one seam each time a seam is to be formed. The drive control mechanism comprises a control circuit for allowing current to flow to a machine motor when no thread amount signal is produced though a position signal is produced at the start of the machine. The safety device comprises a thread paying-out detection circuit operable when a position signal is produced, but no thread amount signal is produced, an alarm for producing a sound or light warning in response to the operation of the thread paying-out detection circuit and a motor stop circuit for interrupting flow of current to a machine motor.

6 Claims, 11 Drawing Figures

39
13
T
T
T
6
13a
12
60c
60
21
60a
9
22
62b
62a
62
45
4
3

7
23
55
52
50
51
32
63
56
58
54
46
49
47
48
45
60
8
31
62a
22
21
60b
21a
9
59
62b
62

DRIVE CONTROL MECHANISM OF SEWING MACHINE

BACKGROUND OF THE INVENTION

This invention relates to a sewing machine control mechanism which is adapted to interrupt a sewing operation when the thread breaks or has been consumed.

One example of the above type of sewing machines is shown in Laid-Open Japanese Patent Application No. 53461/1978. However, the known sewing machine has the disadvantage that because the thread has to be set for driving the machine, the drive of the sewing machine without the thread for noise and durability tests in manufacturing and lubrication, adjustment and confirmation on the part of the operator presents problems.

SUMMARY OF THE INVENTION

The present invention has its purpose to eliminate the disadvantage inherent in the prior art sewing machine referred to hereinabove while maintaining the inherent desirable function of the sewing machine.

Another object of the present invention is to provide a safety device for the sewing machine which detects thread breakage or exhaustion, operates an alarm in response to the detection of thread breakage or exhaustion and at the same time, interrupts supply of current to a sewing machine motor.

As well known in the art, if the sewing machine continues to operate in the absence of thread, objectionable needle holes are formed in the workpiece being sewn. Especially, when the workpiece is formed of leather or artificial leather, quite apparent needle holes are left in such a workpiece resulting in a low quality sewn product.

In order to eliminate this drawback, various detection devices have been developed for detecting thread breakage, but an additional space is required for installing the safety device which adds cost to the cost of manufacture of a sewing machine. Therefore, the safety devices have been exclusively employed in industrial sewing machines.

This invention has its purpose to eliminate the drawbacks inherent in the conventional sewing machines by concurrently utilizing some of the components of the thread feed mechanism in a sewing machine for safety purpose in addition to their inherent functions.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

BRIREF DESCRIPTION OF THE DRAWINGS

PREFERRED EMBODIMENT OF THE INVENTION

The present invention will be now described referring to the accompanying drawings in which one embodiment of the invention is shown.

Figure 1:
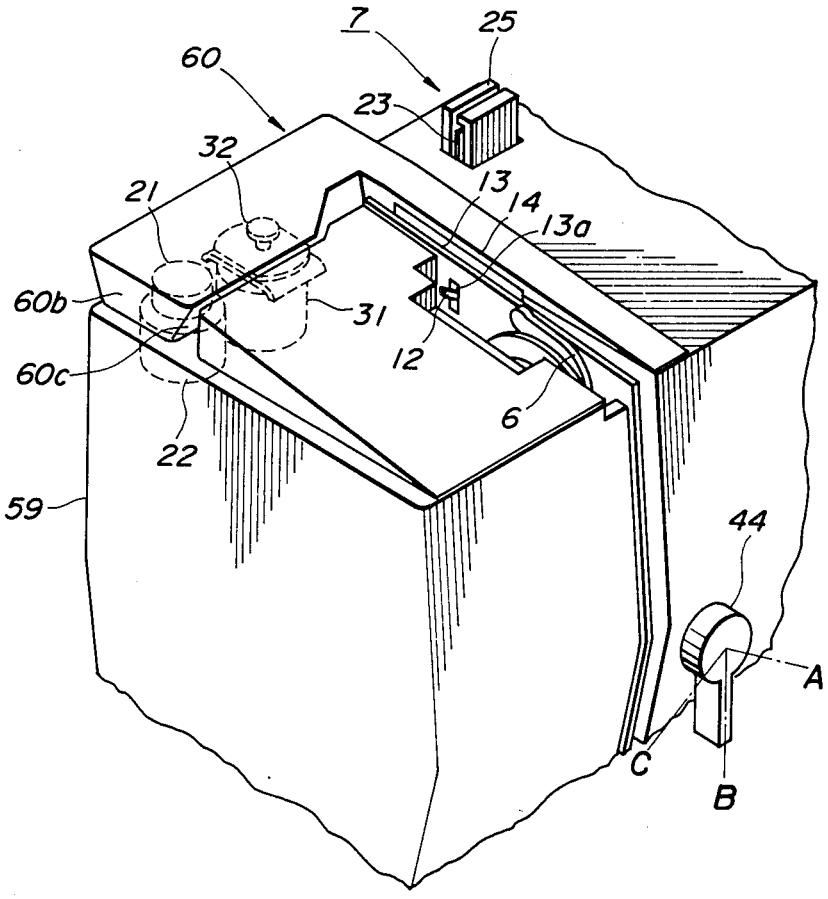
FIG. 1 is a fragmentary perspective view the upper portion of a sewing machine in which the control mechanism of the invention is incorporated.
Figure 2:
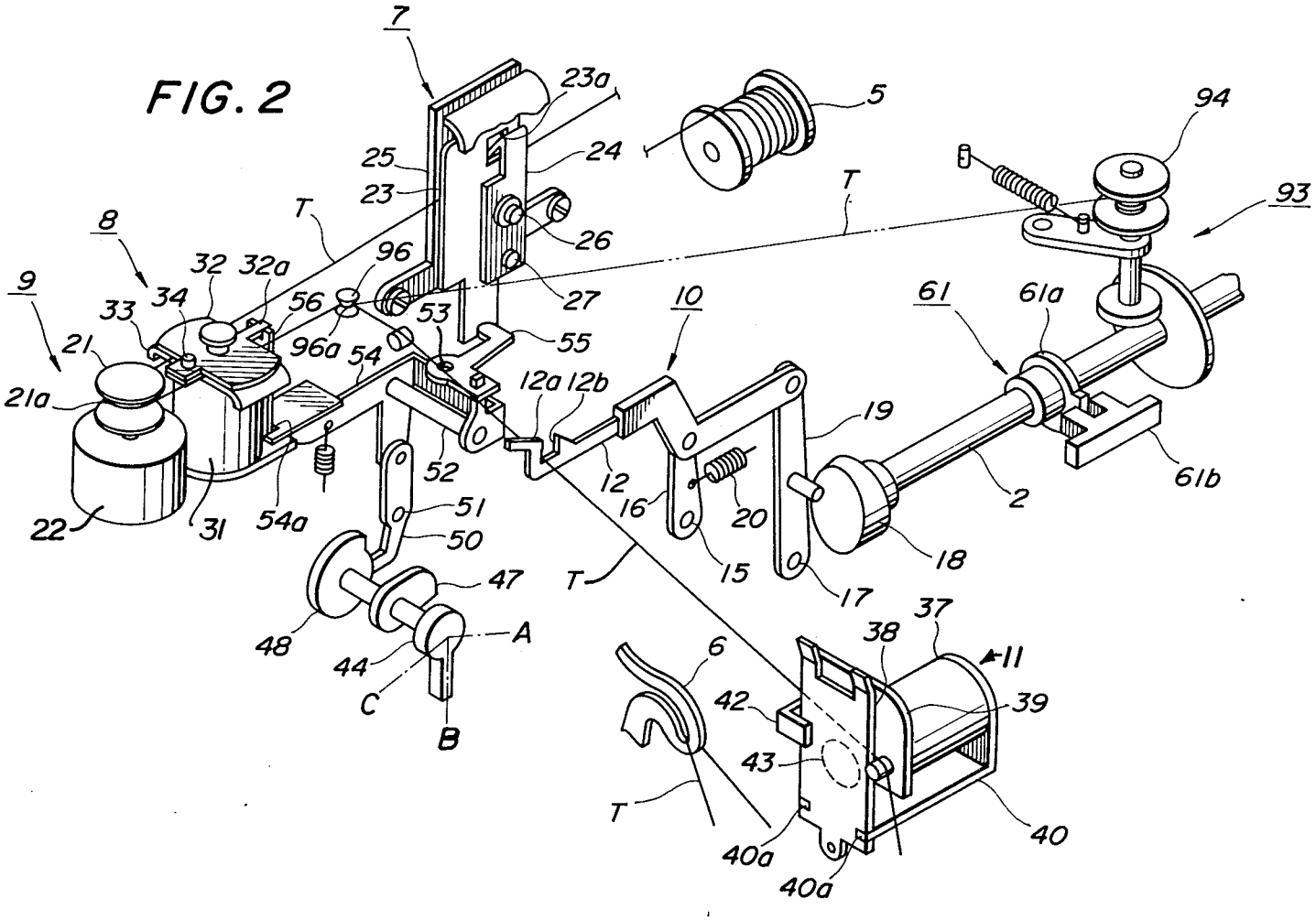
FIG. 2 is an exploded perspective view of the thread feed mechanism of the sewing machine.

In FIGS. 1 and 2, there is shown a sewing machine in which the drive control mechanism of the invention is incorporated. The sewing machine generally comprises a main shaft 2 operatively connnected to a drive source (not shown) to be driven thereby, a vertically reciprocal needle bar 4 movable in response to the rotation of the main shaft 2 and having at the lower end a needle 3 carrying an indefinite length of thread T, a thread take-up lever 6 supporting the thread T between a thread supply source or bobbin 5 and the needle 3 for movement between two positions in response to the rotation of the main shaft 2 so as to strain and slacken the thread T, a thread shearing device (not shown) operable in response to thread shearing signals to shear off the thread extending between the needle 3 and a workpiece to be sewn below the sewing machine bed and a thread winding device 93 associated with a lower thread bobbin to wind the thread about the bobbin. In the sewing machine, the oscillation amplitude of the needle bar 4 and the feed amount and rotative direction of a feed dog are controlled based on informations stored in a memory. The abovementioned arrangement and functions of the components of the sewing machine are conventional. As more clearly shown in FIG. 2, the thread T is passed from the bobbin 5 through the thread tension regulator 7, first holding means 8, paying-out detection device 9, second holding means 11 and prior art thread tension regulator spring to the thread take-up lever 6 sbout which the thread is partially wound.

Figure 5:
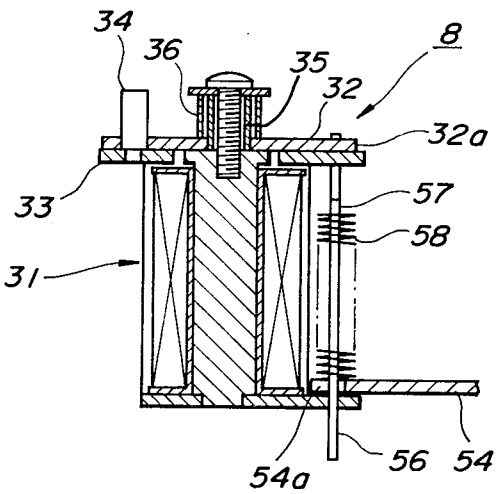
FIG. 5 is a vertically sectional view of the first holding means of the feed mechanism.
Figure 8:
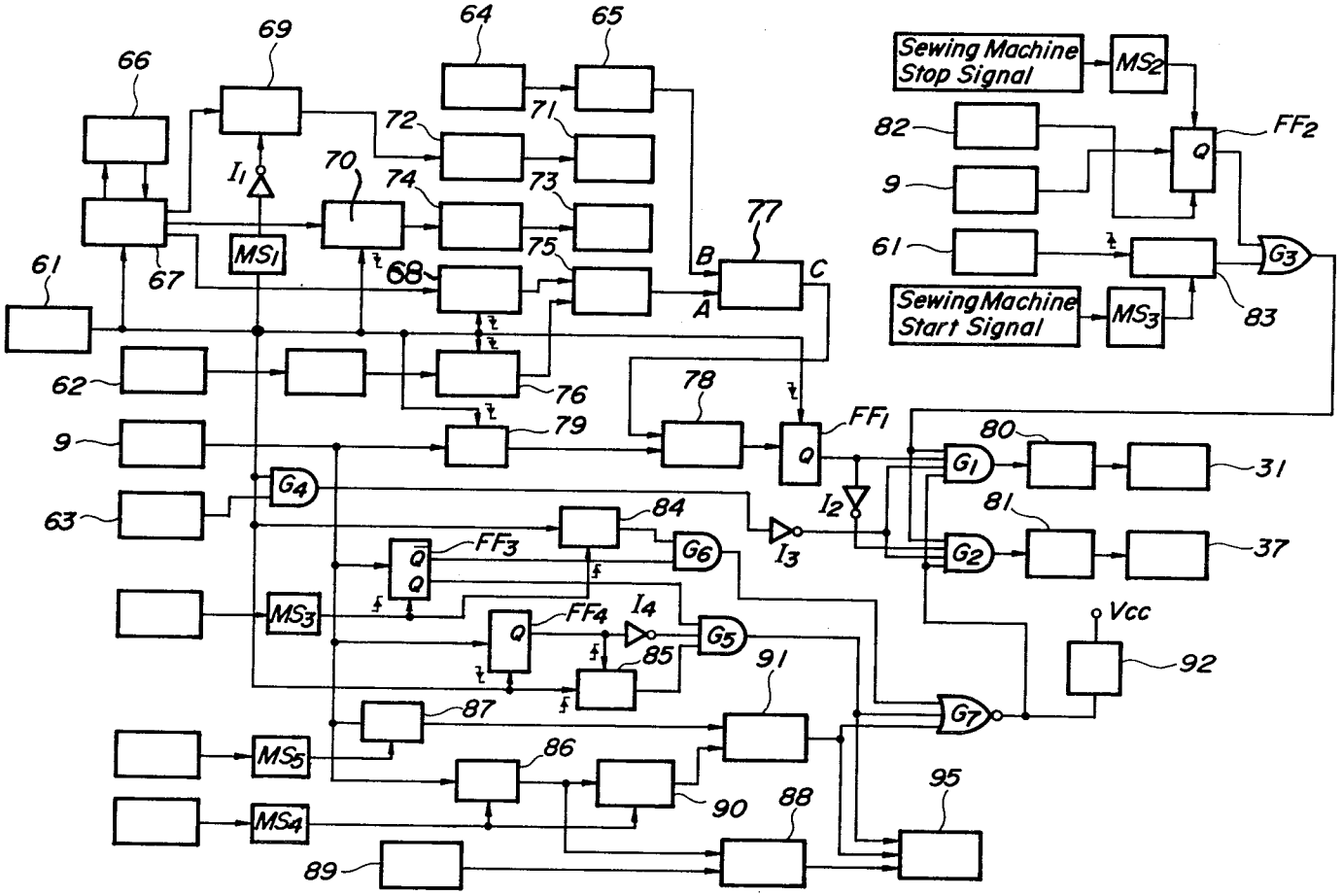
FIG. 8 is a block diagram of the electrical circuit.

The paying-out device 10 has an arm 12 and is adapted to increase the length of the thread path extending between the first and second holding means 8 and 11 when the lower end of the needle 3 is positioned below the upper surface of the sewing machine bed and minimizes the length of the path by the time the lever 6 strains the thread. The arm 12 of the paying-out device has a guide face **12*a* sloping upwardly towards the leading or free end thereof and a U-shaped thread receiving groove 12*b* positioned behind and below the guide face. As more clearly shown in FIGS. 1, 3 and 5, the arm 12 extends through aligned holes 13*a* and 14*a* in two vertically disposed and spaced guide plates 13 and 14 and is pivoted at the base end to the free ends of links 16 and 19 pivoted to stationary stub shafts 15 and 17, respectively. The link 19 is adapted to follow the cam face on a cam member 18 under the influence of a spring 20 extending between and anchored to the link 19** and machine framework.

The paying-out detector 9 is adapted to detect the length of the thread T moving from the bobbin 5 towards the paying-out arm 12 and comprises a pulley 21 having a V-groove 21*a* in the periphery about which the thread T is partially wound and an encorder 22 adapted to produce a pulse each time the pulley 21 rotates by a predetermined angular distance.

Figure 7:
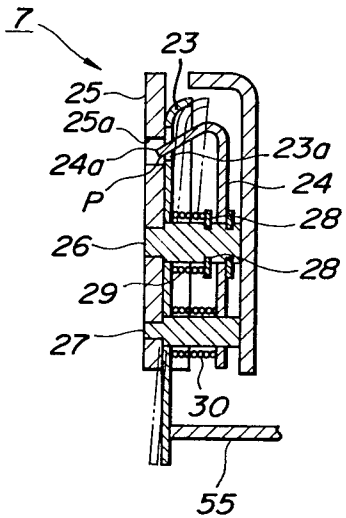
FIG. 7 is a vertically sectional view of the thread tension regulator of the thread feed mechanism.

The thread tension regulator 7 has a thread presser 23 and always presents a constant weak passage resistance to the thread T so as to cause the thread to wind closely about the pulley 21. As more clearly shown in FIG. 7, the thread presser 23 and cooperating shield plate 24 are slidably supported on supports 26 and 27, respectively, which extend inwardly from a vertical plate 25 fixedly secured to the machine framework. The slidable movement of the thread shield plate 24 is limited by rings 28 secured to the support 26 and has the free end 24*a* extending outwardly downwardly into holes 23*a* and 25*a* formed in the thread presser 23 and vertical plate 25, respectively. A coil spring 29 urges the thread presser 23 against the vertical plate 25 and a coil spring 30 imparts a rotating moment to the thread shield 24 to cause the free end 24*a* thereof to enter the hole 25*a*.

The first holding means 8 includes an electromagnet 31, a holding plate or armature 32 and a yoke 33 disposed in opposition to the holding plate 32 so that when the electromagnet 31 is excited or demagnetized the holding plate 32 is attracted to and released from the yoke 33 to thereby pinch the thread between the holding plate and yoke and allow the thread to pass through between the holding plate and yoke. The holding plate 32 is loosely supported on stub shafts 34 and 35 extending upwardly from the yoke 33 for vertical movement along the stub shafts and normally biased downwardly under the influence of a coil spring 36 surrounding the stub shaft 35 to accelerate the attraction of the holding plate 32 by the electromagnet 31.

The upper surface of the yoke 33 is disposed in the same plane as or above the straight line which connects the point of intersection P (FIG. 7) between the V-groove 21*a* in the pulley 21, the thread shield 24 of the thread tension regulator 7 and the thread presser 23 and the V-groove 96*a* in a roller 96 journalled in the machine framework so that the tension on the thread T does not cause the thread presser 32 to separate from the yoke 33 against the force of the coil spring 36 whereby the thread presser 32 is always urged against the upper surface of the yoke 33 under the weak resilient force of the spring 36.

Figure 6:
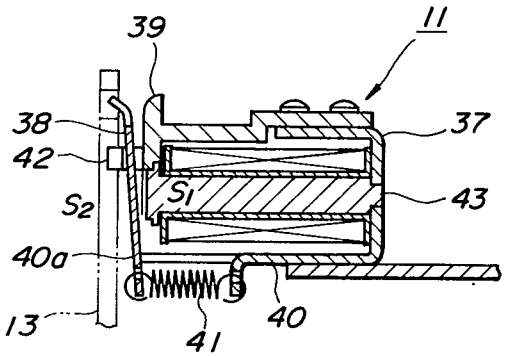
FIG. 6 is a vertically sectional view of the second holding means of the thread feed mechanism.

The second holding means 11 is basically similar to the first holding means 8 in construction and includes an electromagnet 37, a holding plate or armature 38 and a yoke 39 disposed in opposition to the holding plate 38 so that when the electromagnet 37 is excited or demagnetized the holding plate 38 is attracted to or released from the yoke 39 to thereby pinch the thread T between the holding plate or allow the thread to pass through between the holding plate and yoke. As more clearly shown in FIGS. 2 and 6, the holding plate 38 is rockably supported at the fulcrum formed by two spaced projections 40*a* at one end of the support frame 40 of the electromagnet 37 and normally urged away from the yoke 39 under the resilient force of a coil spring 41 extending between and anchored to the holding plate 38 and support frame 40. A limiting member 42 is integrally formed with the yoke 39 to limit the rocking movement of the holding plate 38 away from the yoke 39 so that when the electromagnet is in its demagnetized condition the distance S1 between the opposing faces of the holding plate 38 and an iron core 43 maintained constant. When the holding plate 38 is attracted to the iron core 43 and yoke 39 a clearance S2 is provided between the opposing faces of the holding plate 38 and iron core 43 so that delay in separation of the holding plate 38 from the iron core 43 is prevented when the electromagnet 37 is demagnetized.

An operation lever 44 is rotatably supported by any suitable means (not shown) for rotation between A, B and C positions which correspond to pushing-up, neutral and thread shearing modes, respectively. Integrally supported on the operation lever 44 is a pushing-up cam 47 for raising a presser bar 45 having a presser foot (not shown) at the lower end against the force of a spring 46 and a thread release cam 48 for releasing the nip of the thread T between the thread tension regulator 7 and first holding means 8. When the operation lever 44 is rotated to Position A, the lower surface of a presser bar embracing member 49 integral with the presser bar 45 faces the lever 44 to raise the presser bar 45. Disposed opposite to the thread release cam 48 is a follower 50 connected to a link mechanism which is adapted to move the thread presser 23 to the two-dot chain position (FIG. 7) against the force of the spring 29 and also push the holding plate 32 upwardly against the force of the spring 36 when the operation lever 44 is rotated to Position A or C. The follower 50 rocks about a stub shaft 51 and the rocking movement of the follower 50 is transmitted to the thread presser 23 through links 54 and 55 supported on stub shafts 52 and 53, respectively. Freely received in the bifurcated end 54*a* of the link 54 is the lower end of a vertical connector rod 56 having at the bifurcated upper end in which the engaging portion 32*a* of the holding plate 32 is received and a coil spring 58 having a rating greater than that of the spring 36 extends between and anchored to the connector rod 56 and a horizontal projection 57 of the link 54.

As more clearly shown in FIG. 1, the holding plate 32 of the first holding means 8 and the pulley 21 of the paying-out detection device 9 projects above the upper surface of the top frame 59 of the machine framework and are covered by a cover 60. Three side walls 60*a*, 60*b* and 60*c* of the cover 60 slope downwardly inwardly and when the thread T is wound and pulled about the cover three side walls 60*a*, 60*b* and 60*c*, the thread T slips down of itself and set with respect to the holding means 8 and paying-out detection device 9.

Electrical Circuit

As more clearly shown in FIG. 2, a position detection device 61 consists of a rotatable disc 61*a* secured to the main shaft 2 and a detector 61*b* for detecting the disc 61*a*. The detection device 61 detects an angle of rotation of the main shaft 2 from the time immediately after the lower end of the needle 3 is positioned below the upper surface of the sewing machine bed to the time immediately after the needle end rises above the bed upper surface and produces a position signal of low level (which will be referred to "signal L" hereinafter) and produces position signals of high level (which will be referred to as "signal H" hereinafter) at other angles of rotation of the main shaft.

Figure 4:
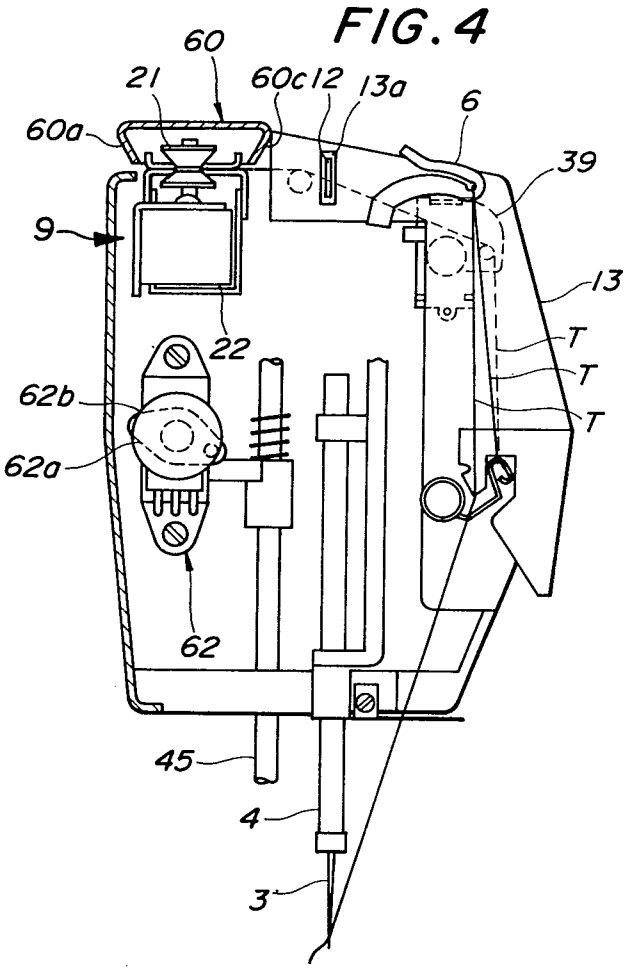
FIG. 4 is an elevational view in partial section as seen from the left-hand side of FIG. 3.
Figure 3:
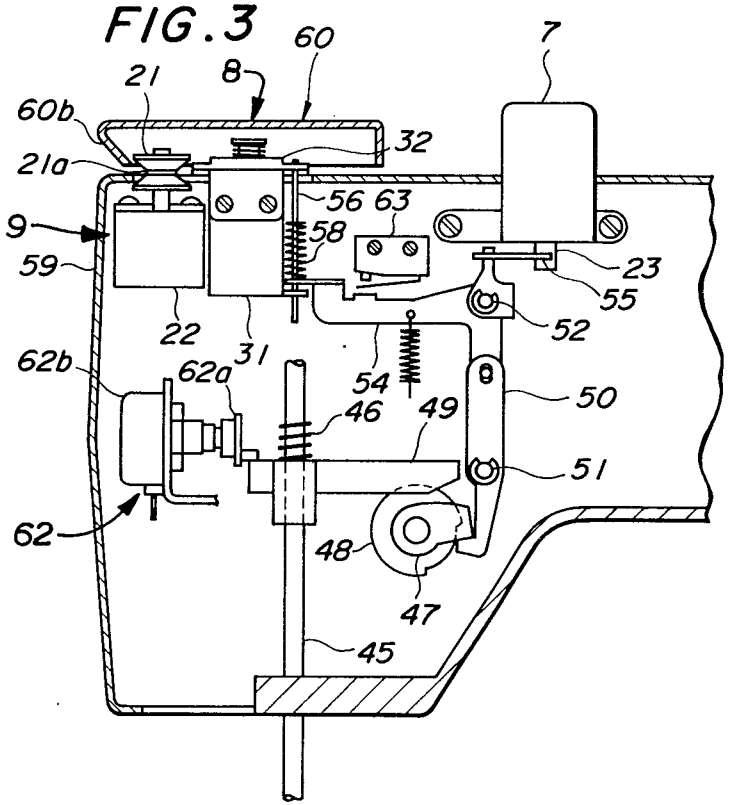
FIG. 3 is a fragmentary elevational view in partial section of the thread feed mechanism.

A workpiece thickness detection device 62 consists of a movable portion 62*a* rotatable in forward and reverse directions in response to upward and downward movements of the presser bar 45 as seen in FIGS. 3 and 4 and a potentiometer 62*b* adapted to produce a voltage (workpiece thickness signal) D corresponding to a particular rotational position of the movable portion 62*a*.

A presser raising switch 63 is disposed within the rocking range of the link 54 as shown in FIG. 3 and adapted to produce a signal H when the manipulation lever 44 is rotated to Position A or C.

A speed detection device 64 detects the rotative speed of the main shaft 2 and produces pulses (speed signals) in a number corresponding to the rotative speed. An error arithmetic unit 65 is adapted to compensate for error in thread paying-out amount caused by delay in operation of the holding plates 32 and 38 of the first and second holding means 8 and 11, respectively and produces pulses in B number obtained by multiplying output pulse in N number of the speed detection device 64 by an experimentally seeked constant k.

A memory circuit 66 is adapted to store informations relating to the amplitude of the needle 3 (amplitude signal Y) and informations relating to the horizontal displacement amount of a workpiece feed dog (not shown) (feed amount signal) for each seam. The stored informations are read through a pattern control circuit 67 for the next seam at the rise of an output of the position detection device 61 and passed to a latch circuit 69 as amplitude and feed amount signals Y and X. Simultaneously, the amplitude signal Y is passed to the latch circuit 68 whereas the feed amount signal X is passed to a latch circuit 70. The latch circuit 69 is operated through amonomultivibrator (one shot) MSl and an inverter Ii in response to the rise of an output of the position detection circuit 61 and the latch circuits 68 and 70 operate in response to the rise of the above-mentioned position signal and output the inputs as they are.

A needle amplitude stepping motor (ST.M) 71 is adapted to operate a needle rocking mechanism and receives an output from the latch circuit 69 to be driven through a drive ciruit 72. A feed stepping motor (ST.M) 73 is adapted to operate a feed mechanism and receives an output of the latch circuit 70 to be driven through a drive circuit 74.

Figure 9:
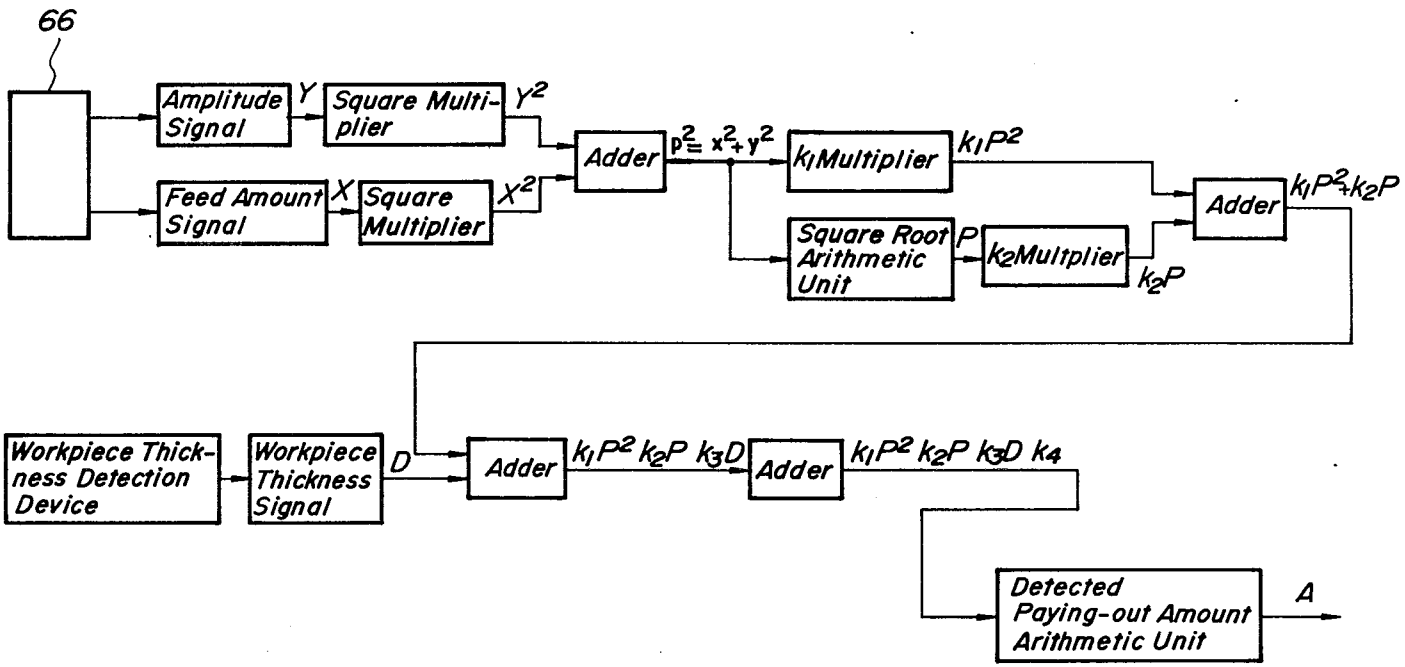
FIG. 9 is a block diagram of one embodiment of the setting device.

A setting device is adapted to set the thread payout amount necessary for the formation of one seam based on signals X, Y and D input thereto through a latch circuit 76. As more clearly shown in FIG. 9, a value $kiP^2$ obtained by multiplying a value $P^2$ which is the addition result of square values of feed amount signal X and needle amplitude signal Y is added to a value $k_2P$ provided by multiplying a square root of $P^2$ by a constant $k_3$ to provide $[KiP^2+k_2P+k_3D]$ to which a constant $k_4$ is further added to provide a value (setting signal) A which is in turn output.

A subtracter 77 outputs a value C which represents an output value A (a theoretical value in FIG. 11) of the setting device 75 minus an output value B from the error arithmetic unit 65 as a repetition signal to a comparison circuit 78 which in turn produces a signal H when the outputs of the substracter 77 and counter 79 coincide with each other. The counter 79 outputs a value provided by computing output pulses of the paying-out detection device 9 and is reset in response to the fall of a position signal.

A flip-flop FF1 operates upon receipt of a signal H from the comparison circuit 78 and is reset to the inoperative condition in response to the rise of a position signal. An output from the flip-flop is passed to an AND gate G2 and an through gate G1 and an inverter L2. Electromagnets 31 and 37 are excited by outputs H of the AND gates G1 and G2 through respectively associated operation circuits 80 and 81, respectively and demagnetized by outputs L from their associated gates, respectively.

A flip-flop FF2 is to prevent the thread T from being fed into between the holding means 8 and 11 during the making of first several sticthes of a first seam after the closing of the power source and during the making of several stitches of the next seam after the removal of the sewn product from the sewing area of the machine and operated in response to the rise of a signal from the paying-out detection device 9 or the rise of a signal instantly produced from an initial setting circuit 82 in response to the closing of the power source. Furthermore, the flip-flop FF2 is reset to the inoperative condition in response to the rise of an output from a oneshot MS2 which operates upon receipt of a sewing machine stop signal produced for machine stop manupulation and an output at the terminal Q of the flip-flop is input to the AND gates G1 and G2 through an OR gate G3. A counter 83 computes the rises of outputs of the position detection device 61 and when the resulting value reaches a predetermined value ("5" in the illustrated embodiment), an output of the counter is inverted from L to H. The counter 83 is reset in response to the rise of an output of a oneshot MS3 which operates upon receipt of a sewing machine start signal generated for machine start manipulation and an output of the counter 83 is input to the AND gates G1 and G2 through an OR gate G3.

The presser raising switch 63 is to release the thread T from the nip between the holding means 8 and 11 when the needle 3 is its upper stop position with the lower end of the needle disposed above the sewing machine bed surface for raising the presser foot and an output of the switch is input to the AND gates G1 and G2 through an AND gate G4 and an inverter I3.

A flip-flop FF 3 is to determine the exahustion or breakage of the thread T when the paying-out detection device 9 produces no output at the beginning of the sewing operation and operates with output pulses from the paying-out detection device 9. The flip-flop is reset to the inoperative condition in response to the rise of an output of the one-shot MS3 which operates with a start signal and an output at the terminal G of the flip-flop is input to an AND gate G5 or an AND gate G6.

A flip-flop FF4 is to determine the exahustion or breakage of the thread T when the paying-out detection device 9 produces no output during the sewing operation and operates with output pulses from the paying-out detection device 9. The flip-flop F4 is reset in response to the rise of an output of the position detection device 61 and an output at the terminal Q of the flip-flop is input to a gate G5 through an inverter I4.

Counters 84 and 85 compute the rises of signals from the position detection device 61 and when the computed value reaches a preset value ("7" stiches in the former counter and "3" stiches in the latter computer in the illustrated embodiment), outputs of the computers are inverted from L to H. The counter 84 is reset in response to the rise of a signal of a one-shot MS3 whereas the counter 85 is reset in response to the rise of a signal of a flip-flop FF4.

Counters 86 and 87 compute output pulses of the paying-out detection device 9 and output the resulting values. The counter 86 is reset in reset in response to the rise of an output of a one-shot MS4 which operates with a bobbin mode-on signal generated in response to the setting of a known lower thread bobbin 93 whereas the counter 87 is reset in response to the rise of a one-shot MS5 which operates with a bobbin mode-on signal generated in response to the release of the inoperative condition of the lower thread winding device 93.

A comparison circuit 88 allows the thread winding device 93 to automatically wind the thread about a lower thread bobbin 94 and an output of the circuit is inverted when the value of an output of a suitably settable thread winding amount setting device 89 and the value of an output of the counter 86 coincide with each other, an output of the comparison circuit is inverted and the inverted output stops the sewing machine motor through a motor stop circuit 95. However, instead it is also possible that a solenoid is excited and the electromagnetic force of the solenoid displaces the thread winding device 93 to its inoperative position.

A memory 90 is to store the amount of thread wound about the lower thread bobbin 94 and also the computed value of the counter 86 and clears its stored informations in response to the rise of an output of the one-shot MS4.

A comparison circuit 91 is to determine the exhaustion of the upper thread in an amount equal to the amount of thread wound about the lower thread bobbin 94 and produce a signal H for a predetermined time period when an output of the memory circuit 90 coincides with an output of the counter 87. And an alarm 92 such as a buzzer or lamp operates for a predetermined time period when an output of a NOR gate G7 becomes L.

Figure 11:
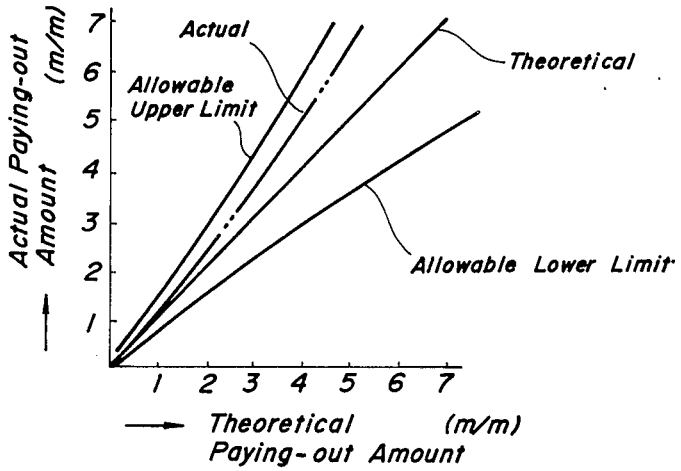
FIG. 11 is a view showing the relationship between a theoretical thread paying-out length and an actual thread paying-out length.

As will be described hereinafter, although the amount of thread necessary for the formation of one seam is obtained by the control of the paying-out movement of the arm 12 of the paying-out member and the operation timing of the holding means 8 and 11, delay in operation of the holding plate 32 of the holding means 8 causes error in the thread paying-out. Thus, in order that an actual paying-out amount of thread will not exceed an allowable upper limit as shown in FIG. 11, the cam face of the cam member 18 is so formed that the paying-out movement is initially slow and thereafter gradually rapid.

With the above-mentioned arrangement of the components of the drive control mechanism of the sewing machine of the invention, the device operates as follows:

The electromagnets 31 and 37 of the holding means 8 and 11 are excited when all four inputs of their respectively associated gates G1 and G2 become H, but when one of the inputs becomes L, the electromagnets are demagnetized. As will be described hereinafter, since three inputs from the gates G3, G4 and G5 are H, normally the excitation or demagnetization of the electromagnets is determined depending upon the output condition of the flip-flop FF1.

Figure 10:
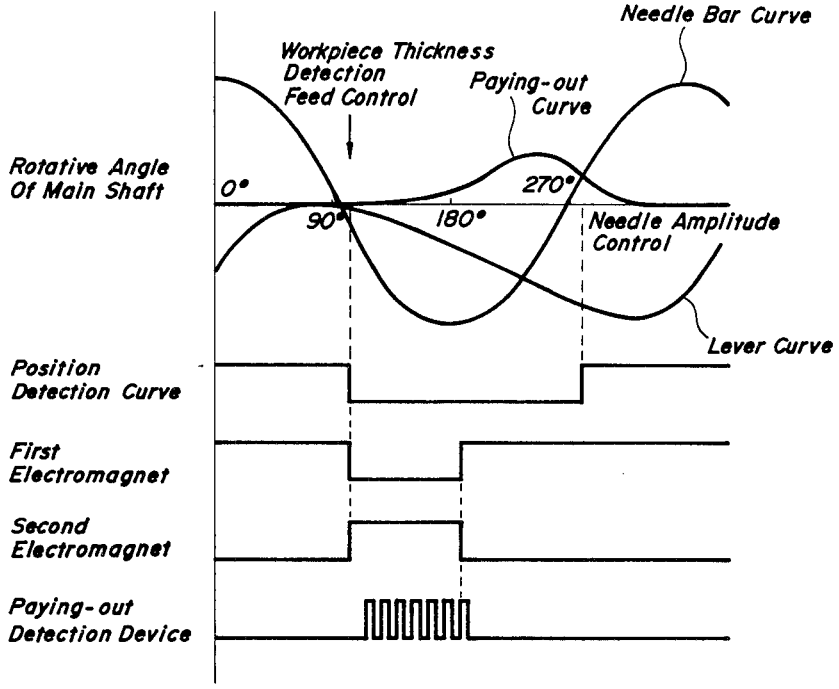
FIG. 10 is a time chart.

In a normal sewing operation, the needle bar 4, thread take-up lever 6 and paying-out member arm 12 reciprocally move along the timing curves as shown in FIG. 10. The outward movement of the paying-out member arm 12 rightwards as seen in FIG. 2 increases the length of the thread path between the holding means 8 and 11, but the flip-flop FF1 is reset by an output L of the position detection device 61 until the time when the paying-out member arm 12 is about to move forward and when an output of the gate G1 becomes L, an output of the gate G2 becomes H and the electromagnet 31 is demagnetized, simultaneously the electromagnet 37 is excited and the holding means 8 releases the thread T whereas the holding means 11 pinches the thread whereby the amount of the thread T corresponding to the increased length of the thread path in the forward movement of the paying-out member arm 12 is fed from the bobbin 5 into between the holding means 8 and 11. At this time, the pulley 21 rotates as the thread T moves and clock pulses in a number in proportion to the angle of rotation of the pulley 21 are produced from the paying-out detection device 9. The clock pulses are computed by the counter 79 and the computed value is passed to one input of the comparison circuit 78. The other input of the comparison circuit 78 is input thereto an output (theoretical value) C. The output C has been obtained by substracting an output value from the error arithmetic unit 65 from a value computed by the setting device 75 based on a feed amount signal X, an amplitude signal Y and a workpiece thickness signal D from the workpiece thickness detection device 62 and when a computed value of the counter 79 coincides with the theoretical value, the comparison circuit 78 outputs a signal H whereby an output of the flip-flop FF1 is inverted from L to H and the electromagnet 31 is excited whereas the electromagnet 37 is demagnetized.

Thus, after a predetermined length of the thread T has been fed into between the holding means 8 and 11, the first holding means 8 pinches the thread T to prevent the thread from passing therethrough whereas the second holding means 11 releases the thread to allow the thread to pass therethrough. When a predetermined length of thread is payed out in a midway of the forward movement of the paying-out member arm 12, the slack T between the holding means 8 and 11 is temporally pulled back into between the holding means 8 and 11 during the rest of the forward movement of the paying-out member arm 12.

And since the arm 12 returns to the initial position before the thread is strained, as the lever 6 rises, the amount of the thread T between the holding means 8 and 11 is gradually increased whereby the formed seam is knotted with a suitable strength. The same procedure is repeated for the formation of each seam.

As mentioned hereinabove, although a required amount of the thread computed based on a feed amount signal X, an amplitude signal Y and a workpiece thickness signal D is payed out each time a seam is formed, the normal amount of thread is not required for initial several stiches in the sewing operation. Thus, when the sewing operation is started after the closing of the power source, since the flip-flop FF2 is preset and the counter 83 is reset with a start signal, an output of the gate G3 remains L until the rise of a signal of the position detection device 61 is computed five times or five stitches in one seam are made, an output of the gate G3 becomes L whereby the gates G1 and G2 are closed and the electromagnets 31 and 37 remain demagnetized. And although the flip-flop FF2 resets when the sewing machine stops its operation, when the workpiece is removed from the sewing area of the sewing machine or displaced from its proper sewing position, the thread T is payed out of the bobbin 5 accordingly and set again with pulse signals from the paying-out detection device 9. Therefore, thereafter, when the sewing operation resumes, the electromagnets remain demagnetized until five stitches are made in a new seam and the thread T can be properly payed out.

In order to turn the workpiece about the needle 3, when the sewing machine operation is interrupted with the needle bar positioned in its predetermined lowest position, even if the presser foot is raised the conditions of the holding means 8 and 11 remain unchanged and are the same as those prior to the interruption of the machine operation because an output of the gate G4 remains L. When the sewing machine resumes its operation, predetermined seams can be in succession formed. However, in order to remove the workpiece from the sewing area, when the sewing machine operation is interrupted with the needle bar positioned in its predetermined highest position, the raising of the presser foot inverts an output of the gate G4 from L to H whereby the gates G1 and G2 are closed which in turn demagnetize the electromagnets 31 and 37 to cause the holding means 8 and 11 to release the thread T. When the sewing machine operation is interrupted with the needle bar positioned in its lowest position, since the holding plate 32 of the holding means 8 is attracted to the yoke 33 by the electromagnetic force, even when the link 54 rotates in the clockwise direction as seen in FIG. 2 in response to the rotation of the cam member 48, the spring 58 is merely compressed. When the sewing machine operation is interrupted with the needle bar positioned in its highest position, since the electromagnetic force is not produced, the holding plate 32 interlocked with the connector rod 56 through the spring 58 rises along the shaft 34 as the fulcrum.

When the thread winding device 93 is set to its operative condition, the counter 86 and memory circuit 90 are reset. Then, when the sewing machine operation is resumed after the thread winding amount setting device 89 has been set, the thread T from the bobbin 5 is rewound about the lower thread bobbin 94 and the thread amount wound on the bobbin 94 is stored in the memory circuit 90 through the detection device 9 and counter 86. When the thread has been wound on the bobbin 94 by a set amount, an output from the comparison circuit 88 interrupts the operation of the sewing machine through the motor stop circuit 95. And the amount of thread consumed in the sewing operation is detect-ed by the detection device 9 and counter 87 and when the consumed thread amount reached the amount wound on the bobbin 94, the comparison circuit 91 produces an output which in turn operates the alarm 92 for a predetermined time period and simultaneously, interrupts the rotation of the machine motor through the motor stop circuit 95.

If the whole amount of the thread T has been consumed or the thread breaks while the sewing machine is operating and the paying-out detection device 9 does not produce an output, the flip-flop FF4 is not set and rising outputs of the position detection device 61 are computed by the counter 85. If the detection device 9 produces no output during the time period in which the computed value from the counter 85 corresponds to a set value or while the main shaft 2 is rotating an output at the gate G5 associated with the detection device 9 becomes H to interrupt the operation of the sewing machine through the motor stop circuit 95 and simultaneously, the alarm 92 operates for a predetermined time period to close the gates G1 and G2 so as to demagnetize the electromagnets 31 and 37.

As mentioned hereinabove, when the power source is open or even after the power source has been closed, if the presser foot is raised while the sewing machine is in its inoperative condition with the needle bar positioned in the vicinity of the upper dead center or the thread T breaks or has been consumed up, since the electromagnets 31 and 37 are demagnetized to cause the holding means 8 and 11 to release their nip on the thread, when the thread T is to be set, the leading end of the thread is gripped and pulled to pay the rest of the thread out of the bobbin 5, the intermediate portion of the thread following the leading end thereof is wound about the cover 60, the leading end of the thread T is pulled with a slight force whereby the intermediate portion is caused to slide down the side walls 60*a*, 60*b* and 60*c*, the leading end of the thread T is further pulled to be drawn into between the holding plate 32 and yoke 33 on the first holding means 8 and then wound about the pulley 21 of the paying-out detection device 9.

When the sewing machine is driven without setting the thread T, the paying-out detection device 9 is reset with a sewing machine start signal and produces an output which is not input to the flip-flop FF3, but an output at the terminal Q of the flip-flop becomes H. Thus, when the main shaft 2 rotates by an angle corresponding to a prede-termined numeral set in the counter 84, an output of the counter 84 becomes H. Thus, in this case, after the main shaft 2 has rotated seven times, the alarm is operated and the electromagnets 21 and 31 are demagnetized.

In the illustrated embodiment, although the set value for the counter 84 is selected as "7", the reason is that regardless whether the thread T is set or not, until five seams have been formed since the start of the sewing operation (the value set for the counter 83 in the illustrated embodiment), the electromagnets 31 and 37 remain demagnetized and thus, the normal paying-out is performed so that if the set value for the counter 84 is not selected greater than that for the counter 83, it is impossible to determine whether the thread T has been set or not. Therefore, the set value for the counter 84 should be greater than that for the counter 83.

And in the illustrated embodiment, in the sewing machine, feed and amplitude signals are previously stored in the memory and read out of the memory each time the main shaft makes one complete rotation. The read signals control the feed mechanism and needle bar rocking mechanism to form a predetermined seam pattern each time a seam is to formed and paying-out signals are obtained by computing the signals read out of the memory or these signals and workpiece thickness signals output from the workpiece thickness detection device corresponding to variation in the upper and lower positions of the presser foot. However, it may be contemplated that from these feed amount and needle bar amplitude signals or a group of thread amount data experi-mentally obtained for different workpiece thicknesses and stored in the memory, the corresponding thread amount data are read out of the memory based on these feed amount and amplitude signals or these signals and workpiece thickness signals.

Furthermore, the invention is applied to a sewing machine in which the feed mechanism and needle bar rocking mechanism operate based on feed and amplitude signals stored in the memory, but the invention is also applicable to the sewing machine in which feed and needle bar amplitude amounts are manually controlled by the operator. In the latter case, paying-out signals can be obtained by computing detection signals corresponding to set values of thread feed and needle amplitude amounts or these signals and workpiece thickness detection signals in the same manner as described hereinabove or corresponding thread amount data can be read out of a thread amount data experimentally seeked and sored.

And the invention can be also applied to the zigzag chain stitch sewing machine in which the needle bar is rocked in a direction intersecting the workpiece feed direction, but the invention is suitably applicable to the sewing machine in which zigzag stitch seam patterns are sewn by moving a workpiece in the X - Y co-ordinate axis with respect to the vertically movable needle bar.

As well known in the art, in such a case, the sewing machine comprises two independent drive sources such as motors for moving a workpiece in the X and Y directions, respectively. The thread amount necessary for the formation of one seam is represented by a square root of the sum of a square value of the movement amount of the workpiece in the X axis direction and the Y axis direction and thus, signals for controlling the direction and angle of each motor may be employed in place of the feed amount and amplitude signals in the illustrated embodiment.

As mentioned hereinabove, according to one aspect of the present invention, in the sewing machine which comprises a position detection device operable in response to occurrence of no further thread amount signal after one occurrence of such a signal despite of occurrence of a position signal and adapted to interrupt current flow to the machine motor and a motor stop circuit associated with a paying-out detection device, since a control circuit adapted to allow continuous current flow to the motor when no thread amount signal produces at the start of the operation of the sewing machine in spite of occurrence of a position signal is provided, the sewing machine can be driven without setting the thread. Thus, noise and trouble that the thread twists about the bobbin case and breakes resulting in the stoppage of the sewing machine can be prevented. Furthermore, the operator can easily lubricates and adjust the sewing machine.

As mentioned hereinabove, according to another aspect of the present invention, in a sewing machine having a thread feed mechanism which comprises a paying-out member operable in synchronization with the operation of a seam formation mechanism to pay thread in a predetermined amount at one time out of a bobbin, a paying-out amount detection device for detecting the amount of thread payed out of the bobbin and holding means for blocking the paying-out of the thread by the paying-out member when the detection device detects that a predetermined amount of thread has been paid out, whereby the thread in an amount necessary for the formation of one seam may be fed from the bobbin to a thread take-up lever each time one seam is to be formed, the paying-out detection device is concurrently used as a safetly device for detecting thread breakage and exhaustion to thereby eliminate the requirement for a device exclusively used for safety purpose.

In the illustrated embodiment, the flip-flop FF1, inverter $I_2$, gates G1 and G2 and operation circuits 80 and 81 constitute the control circuit and the flip-flop FF4 and counter 85 constitute the thread detection circuit.

The invention can be also applied to the sewing in which the thread is not supplied from the bobbin 5 to the thread take-up lever 6 until five seams have been formed since the initiation of the sewing machine operation and the alarm operates when no thread amount signal is produced until seven seams have been formed since the initiation of the sewing machine operation. However, the invention can be also applied to the sewing machine in which the thread is supplied from the bobbin to the thread take-up lever after the formation of a first seam since the initiation of the sewing machine operation. In such a case, the alarm may operate immediately when no thread amount signal is produced after the formation of a first seam or the alarm may not operate in response to no occurrence of a thread amount signal.

While only one embodiment of the invention has been shown and described in detail, it will be understood that the same is for illustration purpose only and not to be taken as a definition of the invention, reference being had for the purpose to the appended claims.

What is claimed is:

1. In a sewing machine comprising a sewing machine motor operable in response to a start signal, a position detection means operatively connected with said sewing machine motor for producing a position signal each time said sewing machine motor operates to a predetermined extent, paying-out detection means disposed in a thread path between a thread take-up lever and a thread supply source for producing a thread feed signal varying depending upon the amount of thread fed from said supply source to said lever, and a motor stop circuit operable in response to the lack of a thread feed signal after the occurrence of a position signal to interrupt operation said sewing machine motor, characterized by a drive control mechanism comprising: control means for operating said motor to drive said sewing machine when a position signal is produced and without a thread feed signal being produced at the start of the operation of said sewing machine.

2. A sewing machine comprising thread storage means for storing thread, thread feed means for feeding thread from said thread storage means during operation of the sewing machine, first means for detecting breaking of the thread during operation of the machine, second means for detecting a feeding of all of the thread in said thread storage means during operation of the machine, and control means for stopping operation of the machine in response to said first means detecting a breaking of the thread during operation of the machine and for stopping operation of the machine in response to said second means detecting a feeding of all of the thread in said storage means, said control means including means for enabling said machine to operate without thread in said machine.

3. A sewing machine operable to sew a workpiece, said sewing machine comprising a needle bar for holding a needle, means for reciprocating said needle bar through operating strokes relative to the workpiece during operation of said sewing machine, thread feed means for feeding thread to the needle during operation of said sewing machine, means for providing a thread feed signal during the feeding of thread by said thread feed means, means for providing needle stroke signals during reciprocation of said needle bar, and control means for interrupting operation of said sewing machine in response to breaking of the thread during operation of said sewing machine and for enabling said sewing machine to be started and operated without thread being fed to the needle by said thread feed means, said control means including counter means for counting strokes of said needle bar during operation of said sewing machine, first means for interrupting operation of said sewing machine in response to the presence of a needle stroke signal and the absence of a thread feed signal after a predetermined number of strokes of said needle bar have been counted by said counter means, and second means for preventing interruption of the operation of said sewing machine by said first means in response to the presence of a needle stroke signal and the absence of a thread feed signal prior to a predetermined number of strokes having been counted by said counter means.

4. A sewing machine as set forth in claim 3 wherein said control means further includes third means for interrupting operation of said sewing machine in response to the feeding of a predetermined amount of thread by said thread feed means.

5. A sewing machine as set forth in claim 4 wherein said third means includes means for storing data corresponding to the predetermined amount of thread to be fed, means responsive to the thread feed signal for determining the amount of thread fed, and means for interrupting operation of said sewing machine when the amount of thread fed corresponds to the predetermined amount of thread to be fed.

6. A sewing machine as set forth in claim 3 wherein said thread feed means includes a first thread holding means disposed at a first location along the thread feed path, said first thread holding means being operable between an engaged condition gripping the thread to hold the thread against feeding movement through the first location and a disengaged condition in which said first thread holding means is ineffective to hold the thread against feeding movement through the first location, second thread holding means disposed at a second location along the thread feed path downstream from the first location, said second thread holding means being operable between an engaged condition gripping the thread to hold the thread against feeding movement through the second location and a disengaged condition in which said second thread holding means is ineffective to hold the thread against feeding movement through the first location, means responsive to the needle stroke signals for effecting operation of said first and second thread holding means between a first state in which said first thread holding means is in the disengaged condition and said second thread holding means is in the engaged condition and a second state in which said first thread holding means is in the engaged condition and said second thread holding means is in the disengaged condition, and means for increasing the length of the thread path between the first and second locations when said first and second thread holding means are in the first state and for enabling the length of the thread path between said first and second locations to be decreased when said first and second thread holding means are in the second state, said control means including means for effecting operation of said first and second thread holding means to a third state in which said first and second thread holding means are both in their disengaged conditions in response to breaking of the thread during operation of the sewing machine.

* * * * *